US007713067B1

(12) United States Patent
Behrent

(10) Patent No.: US 7,713,067 B1
(45) Date of Patent: May 11, 2010

(54) CONNECTOR WITH A CONDUCTIVE SHELL WITH AN EXTENSION TO STRADLE A CIRCUIT BOARD

(75) Inventor: Robert Behrent, Flanders, NJ (US)

(73) Assignee: Bomar Interconnect Products, Inc., Ledgewood, NJ (US)

( * ) Notice: Subject to any disclaimer, the term of this patent is extended or adjusted under 35 U.S.C. 154(b) by 0 days.

(21) Appl. No.: 12/396,563

(22) Filed: Mar. 3, 2009

(51) Int. Cl.
*H01R 12/00* (2006.01)

(52) U.S. Cl. ..... 439/63

(58) Field of Classification Search ..... 439/63, 439/62, 64, 55, 581
See application file for complete search history.

(56) References Cited

U.S. PATENT DOCUMENTS

| | | | | |
|---|---|---|---|---|
| 5,404,117 | A | 4/1995 | Walz | |
| 5,405,267 | A * | 4/1995 | Koegel et al. | 439/79 |
| 5,823,790 | A | 10/1998 | Magnuson | |
| 5,897,384 | A | 4/1999 | Hosler | |
| 6,065,976 | A * | 5/2000 | Wang | 439/63 |
| 6,106,304 | A * | 8/2000 | Huang | 439/63 |
| 6,254,399 | B1 | 7/2001 | Huang | |
| 6,407,652 | B1 | 6/2002 | Kan | |
| 6,457,979 | B1 | 10/2002 | Dove et al. | |
| 6,468,089 | B1 * | 10/2002 | Hubbard et al. | 439/63 |
| 6,682,354 | B2 | 1/2004 | Carson et al. | |
| 6,791,317 | B1 | 9/2004 | Walsh et al. | |
| 6,811,405 | B1 * | 11/2004 | Huang | 439/63 |
| 6,953,866 | B2 * | 10/2005 | Malz et al. | 564/402 |
| 6,957,980 | B2 | 10/2005 | Huang et al. | |
| 7,042,318 | B2 | 5/2006 | Barnes et al. | |
| 7,048,547 | B2 | 5/2006 | Gottwald | |
| 7,344,381 | B2 | 3/2008 | Kerekes | |
| 2004/0038587 | A1 | 2/2004 | Yeung et al. | |
| 2008/0045043 | A1 | 2/2008 | Lee et al. | |
| 2008/0102654 | A1 | 5/2008 | Kari | |

* cited by examiner

*Primary Examiner*—Chandrika Prasad
(74) *Attorney, Agent, or Firm*—Thomas L. Adams

(57) ABSTRACT

A connector adapted for edge mounting on a circuit board employs a conductive shell with at least one insulating spacer mounted therein. A center contact is mounted in the spacer. The proximal end of the shell has an extension adapted to extend proximally and attach to the circuit board. The center contact and the extension are spaced to straddle the circuit board. The extension is disposed along most of its length entirely to the outside of a reference plane that is parallel to and spaced from the center contact. The extension for most of its length extends proximally beyond any portion of the shell located to the inside of the reference plane. A sleeve lining the shell is polished to avoid reflections of electromagnetic energy passing through the shell. A C-shaped clip is attached to the outside of the extension and then pressed into holes on the circuit board while compressing the clip to squeeze the extension.

17 Claims, 3 Drawing Sheets

CONNECTOR WITH A CONDUCTIVE SHELL WITH AN EXTENSION TO STRADLE A CIRCUIT BOARD

BACKGROUND OF THE INVENTION

1. Field of the Invention

The present invention relates to connectors having a conductive shell and a center contact, and in particular, to connectors that are mounted on a circuit board.

2. Description of Related Art

Some connectors are designed to mount on circuit boards. These connectors are often soldered in place on the board. In many cases the connector will have a metal shell with a coaxial metal contact. The distal end of the connector may also have a male (female) fitting that is externally (internally) threaded to accept a mating threaded connector at the end of a cable. Instead of threads, other connectors may have a bayonet fitting, friction fitting, etc.

Connectors must deal with advancing technology that has allowed electronic equipment to handle much higher frequencies. Great advances have been achieved in digital electronics with ever faster clock rates and pulse rise times. With the advent of high-definition television, higher frequency demands have become routine.

In such a high-frequency environment, transferring signals between a cable and a circuit board is more demanding. To transfer electromagnetic energy efficiently, discontinuities ought to be avoided at the connection between the cable and circuit board. For example, cables such as coaxial cables have a characteristic impedance and should be terminated into a matching impedance to avoid reflections. Also, the geometry of the transition should be a designed carefully to avoid irregularities that can cause reflections as well. In addition, one must take into account the dielectric coefficient of intervening elements, including the dielectric coefficient of relevant volumes of air.

The geometry of the connector can determine whether there are discontinuities or other mismatching effects. This geometry is especially important since high-frequency connectors often include metal components and these metal bodies can have capacitive and inductive effects. The undesired presence of such capacitance and inductance may produce a mismatch that can adversely affect the transfer efficiency of the connector.

While high-frequency connectors ought to work well under these demanding conditions, their structure should also be simple, rugged and dependable. Further-more, and assembler should be able to easily and reliably install the connector on a circuit board.

See also U.S. Pat. Nos. 5,404,117; 5,823,790; 5,897,384; 6,106,304; 6,254,399; 6,407,652; 6,457,979; 6,682,354; 6,791,317; 6,811,405; 6,957,980; 7,042,318; 7,048,547; and 7,344,381, as well as U.S. Patent Application Publication Nos. 2004/0038587; 2008/0045043; and 2008/0102654.

SUMMARY OF THE INVENTION

In accordance with the illustrative embodiments demonstrating features and advantages of the present invention, there is provided a connector adapted for edge mounting on a circuit board. The connector includes a conductive shell having a proximal end with an extension adapted to extend proximally and attach to the circuit board. Also included is at least one insulating spacer mounted in the shell. The connector also has a center contact mounted in the at least one insulating spacer. This center contact and the extension are spaced to straddle the circuit board. The extension is disposed along most of its length entirely to the outside of a reference plane that is parallel to and spaced from the center contact. The extension for most of its length extends proximally beyond any portion of the shell located to the inside of the reference plane.

In accordance with another aspect of the invention, there is provided a connector adapted for edge mounting on a circuit board. The connector includes a conductive shell having a proximal end with an extension adapted to extend proximally and attach to the circuit board. Also included is at least one insulating spacer mounted in the shell. The connector also has a center contact mounted in the at least one insulating spacer. The center contact and the extension are spaced to straddle the circuit board. The connector has a sleeve lining the shell and polished to avoid reflections of electromagnetic energy passing through the shell.

In accordance with yet another aspect of the invention, a method employing a conductive shell is provided for connecting to a circuit board. The method includes the step of internally polishing a sleeve to avoid reflection of electromagnetic energy. Another step is fitting the sleeve inside the conductive shell.

In accordance with still yet another aspect of the invention, a method employing a conductive shell with a proximally extending extension is provided for connecting to a circuit board. The method includes the step of attaching a C-shaped clip to the outside of said extension. Another step is pressing the C-shaped clip into holes on the circuit board while compressing the clip to squeeze the extension.

By employing apparatus and methods of the foregoing type an improved connection can be achieved. In a disclosed embodiment a conductive shell contains a coaxial contact mounted in a spaced pair of insulating discs. At least one of these discs has a hollowed inside face that increases the volume of the air dielectric inside the shell in order to enhance the connector characteristics.

To avoid discontinuities, the inside of the disclosed conductive shell is fitted with a polished sleeve. By finely polishing the inside of this sleeve very little electromagnetic energy will be reflected due to internal irregularities.

The proximal end of this disclosed connector has an extension designed to attach the connector to a circuit board. The tip of this extension has an external groove for receiving a C-shaped clip. The free ends of this clip can have a bend, or bight, and are designed to clip into complementary holes on the circuit board. The free ends of the clip are slightly pressed together, which tends to squeeze the clip more securely into the external groove on the extension. Secured in this manner, the circuit board may lay on the extension and reach into an optional notch located at the root of the extension.

Accordingly, the extension will embrace the circuit board on one side, while the opposite side will fit under the coaxial contact that is projecting from the proximal end of the conductive shell. In a disclosed embodiment this coaxial (center) contact will project only a small distance upon the circuit board to avoid unnecessary capacitance and discontinuities. Also, the conductive shell does not extend significantly over the side of the circuit board that receives the center contact, again to avoid discontinuities and undesired capacitive effects.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
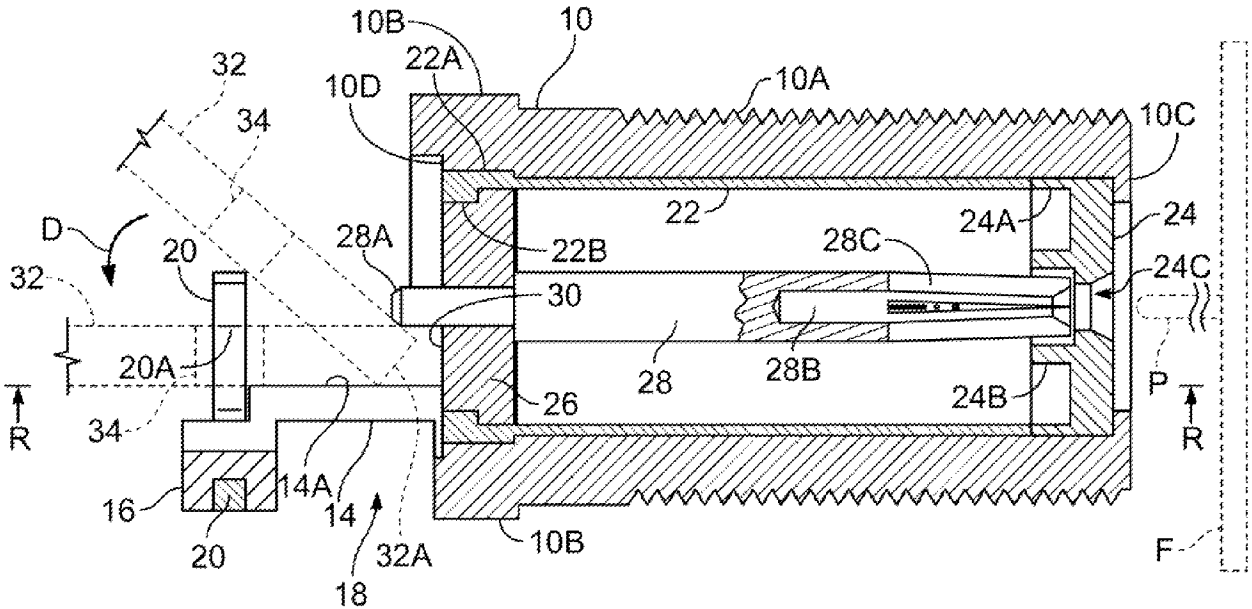
FIG. 1 is a longitudinal sectional view of a connector in accordance with principles of the present invention.
Figure 2:
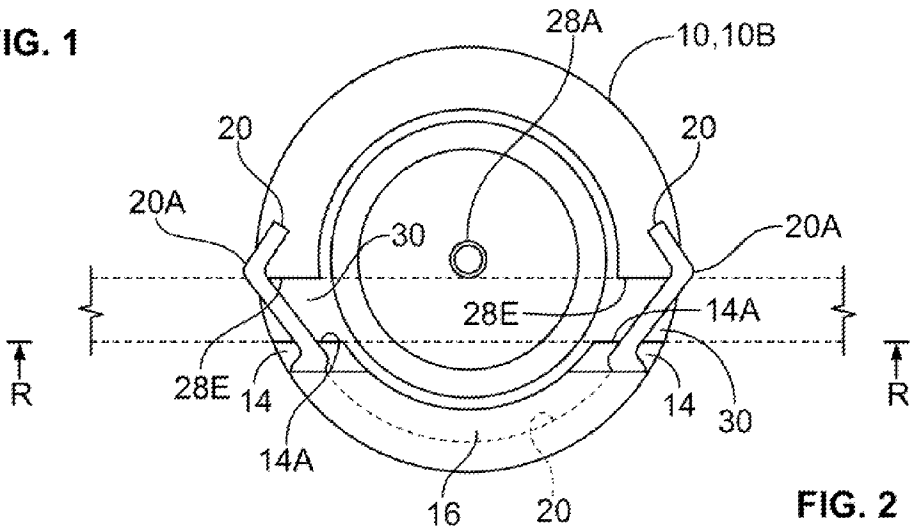
FIG. 2 is an axial view of the proximal end of the connector of FIG. 1.
Figure 3:
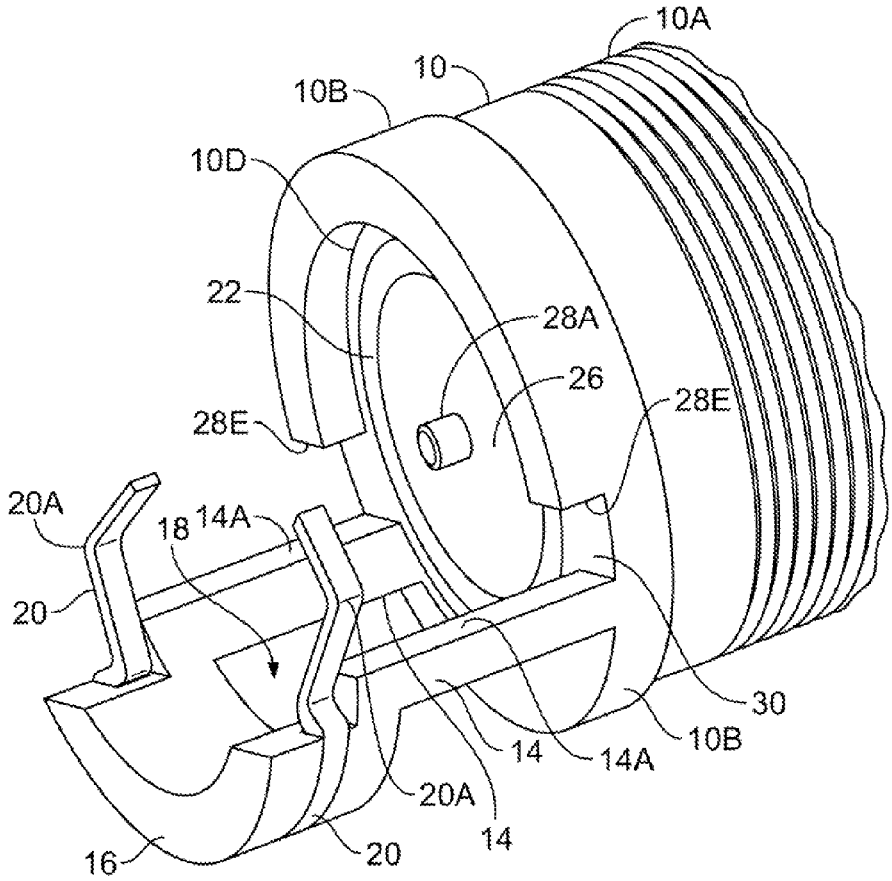
FIG. 3 is a perspective view of the connector of FIG. 1 with a distal portion broken away for illustrative purposes.

Referring to FIGS. 1-3, the illustrated connector has a conductive shell 10 in the form of a hollow cylinder with external threads 10A located to the distal side of a low flange 10B at the proximal end of the shell. In one embodiment threaded portion 10A can have an overall outside diameter of 7/16 inch with 28 threads per inch (e.g., 7/16 28 UNEF 2A), although other types of threading can be used in different embodiments. Shell 10 has at its distal end an inwardly projecting lip 10C.

An integral pair of bars 14 extend proximately from flange 10B to integral crosspiece 16 to form a hole 18. Components 14 and 16 are herein referred to as a proximally extending extension with crosspiece 16 considered the remote tip of the extension. Crosspiece 16 has an axially spaced pair of parallel, flat transverse surfaces. The two other surfaces of crosspiece 16 are sections of a cylinder that are concentric with shell 10 with one facing radially inward and the other radially outward. Bars 14 each have a pair of parallel faces and two other faces that are also sections of a cylinder concentric with shell 10, with one facing radially inward and the other facing radially outward. The portions of bars 14 adjacent to flange 10B are referred to as the root support of the bars.

The flat inside faces 14A of bars 14 are coplanar and define a reference plane indicated in FIGS. 1 and 2 by reference line R-R. Extension 14/16 is located to the outside of reference plane R-R. Portions of shell 10 to the inside of reference plane R-R are herein referred to as the superior portion of the shell.

In one embodiment shell 10 and extension 14/16 are integral and are made of brass plated with nickel or tin (or some other tri-metal plating).

C-shaped clip 20 is pressed into an external arcuate groove running 120° on the outside cylindrical surface of crosspiece 16. The exposed legs of clip 20 are bent into a Z-shaped configuration and each have a bight 20A. In this embodiment clip 20 is made of a spring-type brass plated with tin, although different materials may be used in other embodiments.

Distal insulating spacer 24 is pressed into shell 10 to abut lip 10C. Spacer 24 has an annular inside recess between rim 24A and cylindrical hub 24B. The floor of hub 24B is pierced by a concentric circular hole 24C whose outward portions flare, funnel-like. In one embodiment spacer 24 is made of Teflon™ material (polytetrafluoroethylene), although other materials may be used in different embodiments.

Cylindrical sleeve 22 is pressed into shell 10 with its distal end pressed, against rim 24A of spacer 24 and with its proximal end flush with annular ledge 10D of shell 10. Sleeve 22 has at its proximal end an annular ridge 22A that fits into the illustrated, matching annular recess on the inside of shell 10.

The inside of sleeve 22 is polished to avoid discontinuities and reflections that can adversely affect the passage of electromagnetic energy through the sleeve. In this embodiment the inside of sleeve 22 is initially polished by pneumatically blasting through it a liquid abrasive; for example, tin oxide or aluminum oxide particles suspended in a liquid carrier. Thereafter, sleeve 22 can be internally polished with a soft, felt-like tube carrying a fine abrasive such as jeweler's rouge. Sleeve 22 can be readily polished in this fashion because, it lacks structure such as the large lip 10C and extension 14/16 on shell 10, which would interfere with the polishing process. Sleeve 22 can be made of a base material and plating similar to shell 10, although in some embodiments different materials may be used depending upon the sleeve's desired strength, ease of polishing, electrical characteristics, etc.

The proximal end of sleeve 22 is fitted with a proximal insulating spacer 26, shown as a washer-like device with a shoulder abutting internal ridge 22B of sleeve 22. In one embodiment spacer 26 is made of Teflon™ material, although other materials may be used in different embodiments. Center contact 28 has a cylindrical midsection and a smaller cylindrical pin 28A pressed through a concentric hole in spacer 26. Contact 28 may be phosphor-bronze with gold plating, although different materials may be used in other embodiments.

Pin 28A is about 1.0 mm in diameter and extends beyond spacer 26 by about 1.35 mm and beyond flange 10B by about 0.46 mm (and thus, flange 10B extends 0.89 mm beyond spacer 26), although these dimensions will vary for other embodiments and applications.

For example, good results occur by keeping small the distance D that pin 28A extends beyond the superior portion of shell 10 (i.e., the portion of shell 10 on the pin side of reference plane R-R). The distance D can be kept small in proportion to the overall width W of shell 10. This width W is measured perpendicular to reference plane R-R at the root support of bars 14 of extension 14/16. At the root support of bars 14 the overall width W is the outside diameter of flange 10B. Good electrical characteristics can be achieved by keeping the pin extension D at most one tenth the overall width W. Superior electrical characteristics can be achieved by keeping the pin extension D at most one twentieth of the overall width W.

A distal portion of contact 28 has a coaxial bore 28B forming a wall that is quadfurcated to form four flexible contact fingers 28C that converge at hole 24C. The tips of fingers 28C are bevelled on the inside of their distal end to provide a flared opening for guiding an incoming pin into the space between the fingers. Fingers 28C are shown in their neutral position, which provides clearance around the girth of the fingers relative to the inside surface of hub 24B. Accordingly, fingers 28C have clearance allowing them to spread.

An aligned pair of notches 30 cut into flange 10B produce overhangs 28E parallel to surfaces 14A. The floor of notches 30 are substantially coplanar with ledges 10D.

Figure 4A:
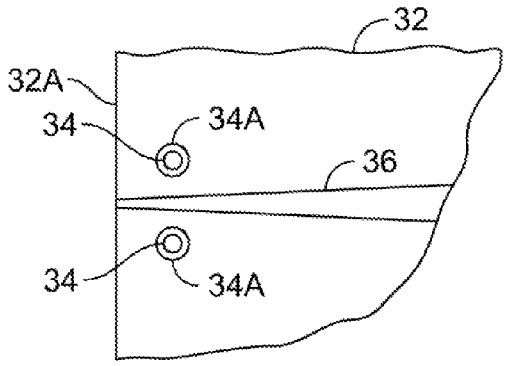
FIG. 4A is a top plan view of a circuit board adapted to receive the connector of FIG. 1.
Figure 4B:
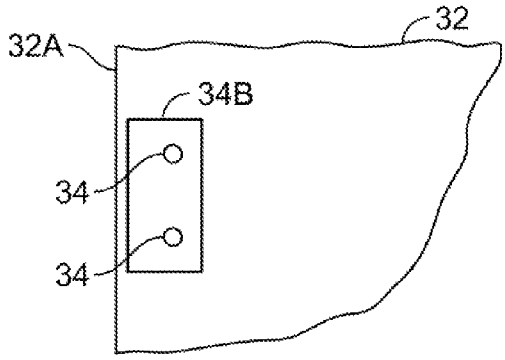
FIG. 4B is a bottom plan view of the circuit board of FIG. 4A.

Circuit board 32 is shown in phantom in two different positions in FIG. 1: (1) an installed position where one side of board 32 lies along reference plane R-R; and (2) a pre-installed position where board 32 is tilted and its primary edge 32A is inserted at an angle between pin 28A and surfaces 14A of bars 14. In this pre-installed position a leg of clip 20 is shown about to slip into hole 34 in board 32. It will be appreciated that board 32, as shown in FIGS. 4A and 4B has a pair of holes 34 and that the two legs of clip 20 will simultaneously slip into these holes. To maintain compatibility with earlier or lower performing models of board-mounted connectors, holes 34 will be spaced inboard about 6 mm and separated about 10.2 mm, although other spacings are contemplated for other embodiments.

The legs of clip 20 are arranged so that they will compress slightly together upon installation into holes 34. The converging slant at the tip of these legs accommodates this compression. The compression of the legs of clip 20 tends to tighten the clip inside the external groove around crosspiece 16. Also, any force tending to separate crosspiece 16 from board 32 will also tend to pull clip 20 more firmly into this groove in the crosspiece thereby making the attachment more secure.

When being installed, board 32 rotates about edge 32A in the direction indicated by arrow D. When Installed, edge 32A will fit between and will be straddled by pin 28A and bars 14.

Under undisturbed, neutral conditions, center contact 28 is cantilevered perpendicularly on spacer 26 and the flexible fingers 28C have clearance within hub 24B of spacer 24. It will be noticed that as board 32 is being rotated into position, it will act as a lever with a tendency to disturb the positioning of pin 28A. To increase the support of contact 28, the pin P of fixture F may be inserted between the fingers 28C before installing board 32. This insertion of pin P will spread fingers 28C so they engage and receive support from the inside surface of hub 24B. Also, keeping the cantilevered length of pin 28A small reduces its effective lever arm and thereby reduces the likelihood of disturbing contact 28 when installing board 32.

After board 32 is locked in place in alignment with extension 14/16 and reference plane R-R, pin P is then withdrawn. Improved performance can be achieved by reducing as far as possible any gap between primary edge 32A and spacer 26. In any event, board 32 will be held in position securely enough by slip 20 and notch 30 to accommodate surface soldering or reflow soldering.

Figure 5A:
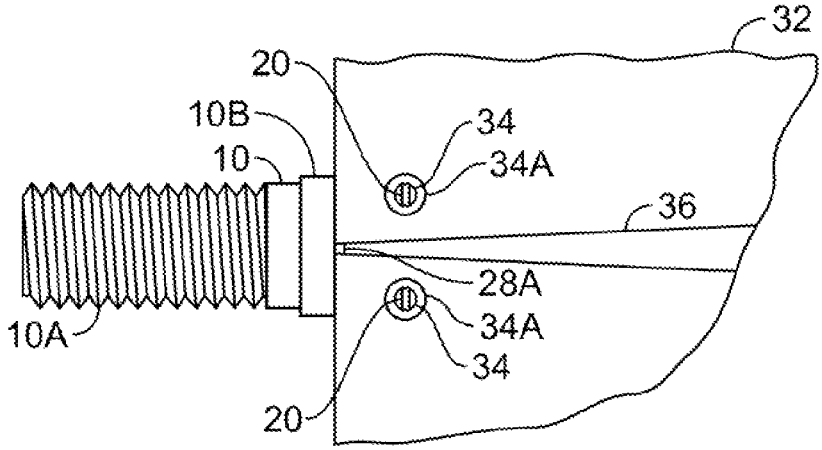
FIG. 5A is a top plan view of the connector of FIG. 1 installed on the circuit board of FIG. 4A.
Figure 5B:
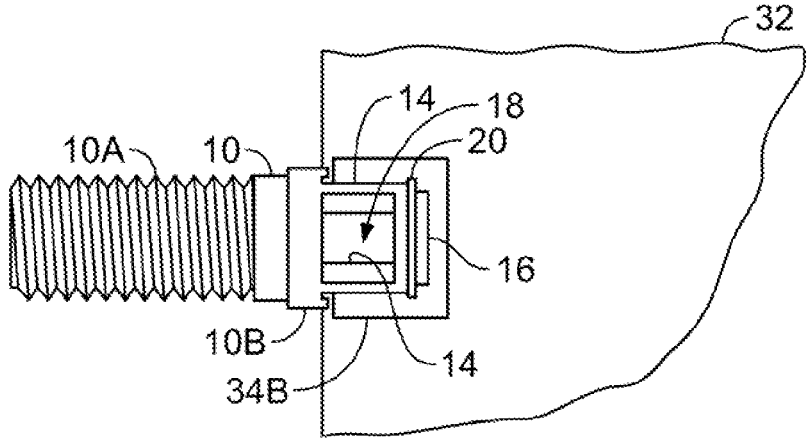
FIG. 5B is a bottom plan view of the connector and board of FIG. 5A.

As shown in FIGS. 5A and 5B the legs of C-shaped clip 20 pass through holes 34, which are plated-through holes connecting to two annular conductive lands 34A on one side, and on the other side to a rectangular conductive plane 34B.

The connector may be soldered in place by filling hole 18 with molten solder (FIG. 5B). Filling hole 18 with solder will prevent components 10B, 16, and 18 from acting like an inductive loop. Simultaneously, solder will flow around the legs of clip 20 and through holes 34 to firmly attach the clip and thus the extension 14/16 to board 32.

Also at this time, solder will flow between pin 28A and trace 36 on board 32 to make an electrical connection. In some embodiments, trace 36 may descend over the edge 32A of board 32.

It will be noticed that a relatively small length of pin 28A extends over the board 32 and trace 36 (1.35 mm in this embodiment). Accordingly, pin 28A produces little inductive and capacitive effects and allows top mounting on board 32. Also, connector 10, including flange 10B, does not extend significantly onto board 32 (0.89 mm in this embodiment), again to avoid unwanted inductive and capacitive effects.

Figure 6:
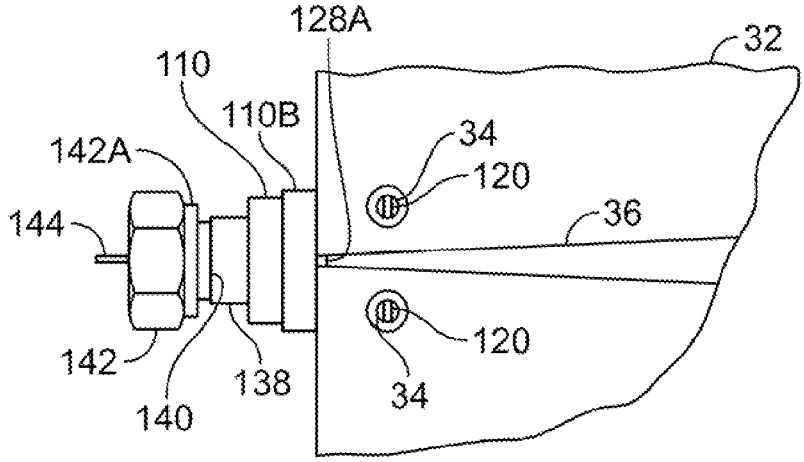
FIG. 6 is a top plan view of the circuit board of FIG. 4A fitted with a connector that is an alternate to that of FIG. 1.

Referring to FIG. 6, an alternate connector 110 is shown attached to previously mentioned circuit board 32. Components in this Figure corresponding to those previously illustrated bear the same reference numerals but raised by 100. In particular, the structure of connector 110 around flange 110B and to the right (proximal direction) is the same as before and will include the same previously mentioned extension (extension 14/16 of FIG. 1) with a clip, shown herein as clip 120 inserted into holes 34. To the left of flange 110B (distal direction) the previously described threads (threads 10A) are placed with a reduced diameter neck 138 having a groove 148. An internally threaded hex nut 142 has a back collar 142A with an inward lip (not shown) that fits into groove 140 allowing the nut to rotate 360° and slide axially a small amount.

Connector 110 has a central contact with a pin 128A extending onto trace 36 as before. Also as before, the mid-section of the central contact (not shown) is again a solid cylindrical shaft but now its distal end is formed into a slender contact pin 144, which replaces the previously described flexible fingers (fingers 28C of FIG. 1). In a manner similar to that previously described in connection with FIG. 1, the central contact 128A/144 will be supported inside connector 110 by a spaced pair of insulating spacers (not shown). The threaded connection provided by nut 142 and contact 144 is arranged much like a video-grade coax connector. In fact the connector of FIG. 6 is the complementary mate to the connector of FIG. 1.

Referring again to FIGS. 1-3, once the illustrated connector has been installed on a circuit board 32 as shown in FIGS. 5A and 5B, the connector can connect to a coaxial cable; for example, a cable carrying high definition television signals. Threads 10A can threadably receive a cable fitting that is similar to that shown on the distal end of the connector FIG. 6. Such a cable fitting will have a pin and nut similar to pin 144 and nut 142 of FIG. 6. This pin will be inserted through hole 24C and between fingers 28C, prying them apart. The deflection of fingers 28C produces a squeezing pressure as well as a wiping action on the incoming pin to establish a good electrical contact.

The nut on the cable fitting (see nut 142 of FIG. 6) is then screwed in place to firmly secure the connection. The foregoing is a similar to the operation occurring with conventional RF connectors (e.g., threaded F-type connectors).

The separation of fingers 28C gives the fingers an increased overall outside diameter thereby giving central contact 28 a consistent outside diameter over most of its length in order to reduce discontinuities and signal reflections. This enhances the radiation pattern and impedance characteristics of the connector. Also, the spreading of fingers 28C bring them in proximity to the inside of hub 24B to in order to stabilize contact 28 inside spacer 24.

RF signals may now be conveyed through the connector of FIGS. 1-3 in either direction. This connector has the advantage of being able to handle signals whose frequency content ranges from 0 Hz up to 10 GHz; although for some designs the tolerances and materials will be chosen to handle a maximum frequency to 8 GHz or less. The signals conveyed through the connector can be a modulated high frequency carrier, but in many embodiments the connector will convey digital pulses of short duration and fast rise time.

Signals passing through connector shell 10 will be affected by the dielectric constants of spacers 24 and 26, as well as the dielectric constant of the air between the spacers inside sleeve 22. It has been determined that better transfer characteristics are achieved with an air dielectric, but spacers 24 and 26 are needed to support central contact 28. Accordingly, spacer 24 has an annular recess between rim 24A and hub 24B that increases the volume of the air dielectric between the two spacers.

Some surfaces of the connector may have small imperfections that constitute small discontinuities, but these can still produce a significant cumulative effect when many small imperfections are distributed over a significant distance. It has been discovered that polishing the inside surface of sleeve 22 in shell 10 reduces the cumulative effect of small irregularities and significantly improves the connector's ability to handle high frequency signals. (In some embodiments that lack a sleeve, the shell itself may be polished.)

In the disclosed embodiment the contributions of sleeve 22 are significant because the sleeve represents about 80% of the inside surface of the connector (extension 14/16 being excluded). As noted before, sleeve 22 can be finely polished because it lacks large ridges or large extraneous structures that can interfere with the polishing process.

Electromagnetic energy conveyed through connector shell 10 or the cable fitting attaching to threads 10A are confined in a coaxial environment; that is, a conductive cylindrical shell around a slender concentric conductor. This coaxial environment is fairly immune to external interferences (external fields or conductors). Also, stray capacitive and inductive effects are not predominating concerns.

However, when transitioning from a coaxial environment to a circuit board, a signal can be significantly affected by external fields, external conductors, and stray capacitive and inductive effects. It has been discovered that these effects are most deleterious when they impinge on the non-grounded circuit traces on the associated circuit board, in this case trace 36 of FIG. 5A. For this reason, pin 28A extends over circuit board 32 a relatively short distance, in this embodiment, 1.35 mm. For the same reason, shell 10 and flange 10B extend over board 32 a relatively short distance, in this embodiment, 0.89 mm. It will also be noted that trace 36 tapers down to a width corresponding to the diameter of pin 28A in order to reduce transition discontinuities.

On the other side of board 32 extension 14/16 presents to trace 36 a relatively simple grounded plane whose effects can be anticipated and compensated for, without significant involvement of the bulk represented by the far side of extension 14/16. Thus board 32 and its traces can be designed and tested without undue concern about the effect of any board-mounted connector.

It is appreciated that various modifications may be implemented with respect to the above described embodiments. For example, in some embodiments the illustrated extension maybe a solid block that is a portion of a cylinder, parallelepiped, ovoid, etc. Also, the legs of the clip may be straight, have a simpler bowed shape, have a non-uniform cross-section, etc. Instead of two spacers, other embodiments can have one spacer or more than two spacers. Also, every spacer may have a recess to increase the air dielectric. Furthermore, the various dimensions can be altered to accommodate different power ratings, strength requirements, temperature stability considerations, etc. In addition, the connector may have optional hardware for panel mounting, surface mounting, etc.

Obviously, many modifications and variations of the present invention are possible in light of the above teachings. It is therefore to be understood that within the scope of the appended claims, the invention may be practiced otherwise than as specifically described.

The invention claimed is:

1. A connector adapted for edge mounting on a circuit board, the connector comprising:

a conductive shell having a proximal end with an extension adapted to extend proximally from an edge of said circuit board and attach to said circuit board;

at least one insulating spacer mounted in said shell; and a center contact mounted in said at least one insulating spacer, said center contact and said extension being spaced to straddle said circuit board, said extension being disposed along most of its length entirely to one side of a reference plane that (a) is parallel to and spaced from a longitudinal axis of said center contact, and (b) the edge of said circuit board has a portion lying between the extension and the longitudinal axis of said center contact said extension for most of its length extending proximally beyond any portion of said shell that is not part of said extension.

2. A connector according to claim 1 wherein said at least one spacer has at least one inside recess for increasing the volume of air dielectric within said conductive shell.

3. A connector according to claim 1 wherein said at least one spacer comprises:

a distal spacer with at least one inside recess and a rim overhanging said at least one recess; and a proximal spacer.

4. A connector according to claim 3 wherein said center contact has a distal end slotted to form a plurality of flexible contact fingers, said fingers fitting into said distal spacer with clearance allowing outward flexing from a neutral position.

5. A connector according to claim 1 comprising:

a clip mounted on said extension and having a pair of legs extending to the inside of said reference plane, said clip being adapted to clip into holes in the circuit board.

6. A connector according to claim 5 wherein said extension has an arcuate external groove, said clip being C-shaped and mounted in said external groove.

7. A connector according to claim 6 wherein each of said legs has a bight.

8. A connector according to claim 1 wherein said extension comprises:

a pair of proximally extending bars; and a crosspiece, said bars and said crosspiece forming a hole for solderability.

9. A connector according to claim 8 wherein said crosspiece has an outside cylindrical surface.

10. A connector according to claim 1 wherein said shell has an internal surface polished to avoid reflections of electromagnetic energy passing through said shell.

11. A connector according to claim 1 comprising:

a sleeve lining said shell and polished to avoid reflections of electromagnetic energy passing through said shell.

12. A connector according to claim 1 wherein said extension has a root support opposite a remote tip, said shell having at said root support a predetermined overall width measured transverse to said reference plane, said shell having a superior portion located to the inside of said reference plane, said center contact reaching no further than a location extending beyond the superior portion by at most one tenth the predetermined overall width.

13. A connector according to claim 12 wherein said center contact reaches no further than a location extending beyond the superior portion by at most one twentieth the predetermined overall width.

14. A connector according to claim 12 wherein said center contact terminates at a location beyond the superior portion.

15. A connector adapted for edge mounting on a circuit board, the connector comprising:

a conductive shell having a proximal end with an extension adapted to extend proximally and attach to said circuit board;

at least one insulating spacer mounted in said shell;

a center contact mounted in said at least one insulating spacer, said center contact and said extension being spaced to straddle said circuit board; and a sleeve lining said shell and polished to avoid reflections of electromagnetic energy passing through said shell.

16. A connector according to claim 15 wherein said at least one spacer comprises:

a distal spacer with at least one inside recess and a rim overhanging said at least one recess; and a proximal spacer.

17. A connector according to claim 16 wherein said extension has an arcuate external groove, said connector comprising:

a C-shaped clip mounted in said external groove and being adapted to clip into holes in the circuit board.

* * * * *